US005345246A

United States Patent [19]

Sezai

[11] Patent Number: 5,345,246

[45] Date of Patent: Sep. 6, 1994

[54] ANTENNA DEVICE HAVING LOW SIDE-LOBE CHARACTERISTICS

[75] Inventor: Toshihiro Sezai, Tokyo, Japan

[73] Assignee: National Space Development Agency of Japan, Tokyo, Japan

[21] Appl. No.: 95,571

[22] Filed: Jul. 19, 1993

[30] Foreign Application Priority Data

Aug. 11, 1992 [JP] Japan ..... 4-234108

[51] Int. Cl.[5] ..... H01Q 3/22; H01Q 3/24

[52] U.S. Cl. ..... 342/368; 342/371; 342/372

[58] Field of Search ..... 342/368, 371, 372

[56] References Cited

U.S. PATENT DOCUMENTS 3,811,129 5/1974 Holst .
4,228,436 10/1980 Dufort .
4,257,050 3/1981 Ploussios .
4,580,141 4/1986 Gutleber .

FOREIGN PATENT DOCUMENTS 3839945 5/1990 Fed. Rep. of Germany .

OTHER PUBLICATIONS

Proceedings of the IEEE Proceedings Letters, vol. 66, No. 3, Mar. 1978, New York pp. 347–349, Vishwani D. Agrawal "Grating-Lobe Suppression in Phased Arrays by Subarray Rotation".

*Primary Examiner*—Theodore M. Blum
*Attorney, Agent, or Firm*—Armstrong, Westerman, Hattori, McLeland & Naughton

[57] ABSTRACT

There is disclosed an antenna device having low side-lobe characteristics comprising a pair of array antennas having the same construction. Each array antenna has array elements equidistantly arranged. The center-to-center distance between the array antennas is so determined that the angle of the first zero point of the array factor determined by the center-to-center distance equals the angle of the first side lobe point of the pattern of each array antenna. The array antennas are electrically connected so as to become excited in phase.

6 Claims, 6 Drawing Sheets

ANTENNA DEVICE HAVING LOW SIDE-LOBE CHARACTERISTICS

BACKGROUND OF THE INVENTION

1. Field of the Invention

The present invention relates to an antenna apparatus which reduces the side lobes without increasing the beam width of the antenna pattern.

2. Description of the Related Art

The antenna pattern of general type of antenna including receiving antennas is improved as the beam width and the side lobes thereof, indexes of a good antenna pattern, are reduced.

A known antenna device comprising two antennas arranged apart from each other utilizes the multiplication principle of the directional characteristics of antennas in order to reduce the beam width of the antenna device. According to this principle, the combined pattern of the antenna device is obtained by multiplying the pattern of the individual antennas by the array factor of the antenna device. FIG. 1 schematically illustrates such an antenna device. The antenna device comprises first and second antennas 101, 102 which are arranged so that the distance a between the centers of the first and second antennas 101, 102 is equal to or greater than the aperture length b of each of the antennas 101, 102. By this arrangement, the angle of the first zero point of the array factor of the antenna device becomes smaller than the angle of the zero point of the pattern of the individual antennas 101, 102, thereby reducing the beam width of the antenna device.

However, the conventional art, including the above-described method for reducing the beam width, fails to reduce either one of the beam width and the level of side lobes, that is, indexes of a good antenna pattern, without increasing the other. According to the conventional art, a reduction of the beam width results in an increase of the level of side lobes, and a reduction of the level of side lobes results in an increase of the beam width.

This drawback of the conventional art may cause problems. For example, if the side lobe level of a radar antenna is reduced and, therefore, the beam width thereof is inevitably increased, the resolution of the radar deteriorates, thus reducing the object distinguishing power of the radar. In such a case, the radar may fail to distinguish a plurality of objects and, instead, recognize them as a single object. If the beam width of a radar is reduced and, therefore, the side lobe level is inevitably increased, the radar may make an error in determining whether there are any objects in the direction of the beam (the observation direction). More specifically, if no object exists in the observation direction but an object exists in the direction of the thus-enhanced side lobe, the radar may determine that there is an object in the observation direction.

Because neither one of the beam width and the side lobe level can be reduced without increasing the other, the conventional art merely provides a compromise solution based on distributions, for example, Chebyshev distribution, in which the minimum beam width is obtained with respect to a certain side lobe level, or in which the minimum side lobe level is obtained with respect to a certain beam width.

SUMMARY OF THE INVENTION

Accordingly, an object of the present invention is to provide an antenna device which reduces the side lobe level of the antenna pattern without increasing the beam width thereof.

To achieve the objects of the present invention, the antenna device of the present invention comprises: a pair of array antennas having the same construction and are arranged so that the centers of the array antennas are apart from each other by a center-to-center distance, the center-to-center distance being determined so that the angle of the first zero point of the array factor determined by the center-to-center distance equals the angle of the first side lobe point of the pattern of each of the array antennas; and means for electrically connecting the array antennas in phase, thereby reducing the side lobe level of the combined antenna pattern of the antenna device.

The pattern of the antenna device thus constructed becomes a combined pattern obtained by multiplying the pattern of the individual array antennas by the array factor determined based on the distance between the centers of the array antennas, according to the multiplication principle of the directional characteristics of array antennas. Because, according to the present invention, the pair of antennas arrays are so arranged that the angle of the first zero point of the array factor equals the angle of the first side lobe point of the pattern of the individual array antennas, the antenna device achieves a combined antenna pattern in which the first side lobe is eliminated at the angle of the first side lobe point. Since the first side lobe is generally the largest of all the side lobes in an antenna pattern, elimination of the first side lobe at the angle of the first side lobe point significantly reduces the total side lobe level.

Incidentally, because the distance between the centers of the two antennas must be smaller than the size of the aperture of the antennas in order to equalize the angle of the first zero point of the array factor to the angle of the first side lobe point of the individual antennas, the present invention is not applicable to an antenna having a real aperture, such as a parabola antenna. Thus, the present invention must employ array antennas.

Further objects, features and advantages of the present invention will become apparent from the following description of the preferred embodiment with reference to the attached drawings.

DESCRIPTION OF THE PREFERRED EMBODIMENT

The preferred embodiment of the present invention will be described hereinafter with reference to the attached drawings.

Figure 2:
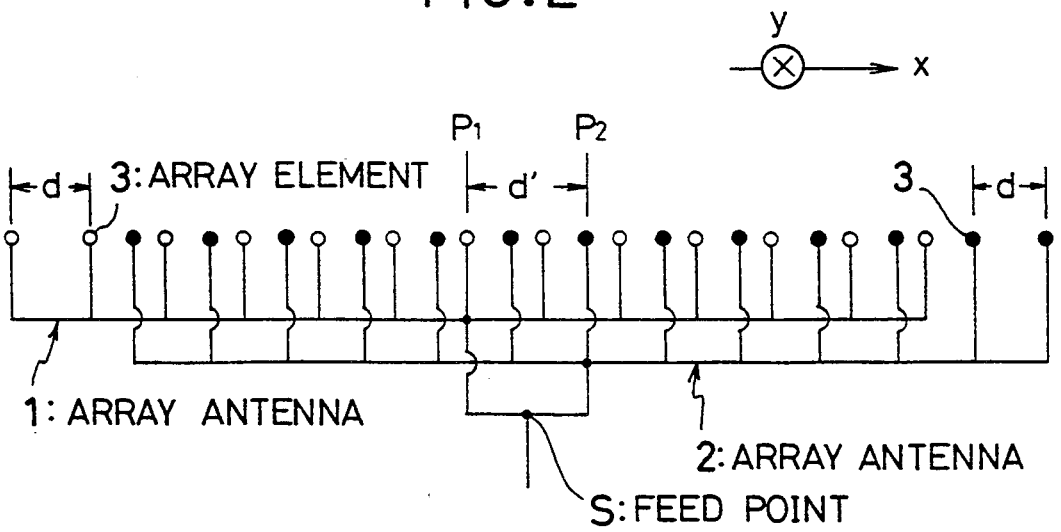
FIG. 2 is a schematic diagram illustrating the principles of the antenna device of the present invention.
Figure 3:
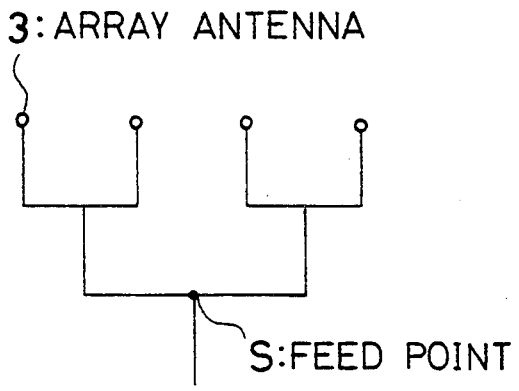
FIG. 3 illustrates an example of the in-phase coupling of an array antenna according to the present invention.

Referring to FIG. 2, two array antennas 1, 2 have the same construction in which a number N (13 in FIG. 2) of array elements 3 are arranged leaving intervals d along the x axis indicated by the arrow x in the figure. The two array antennas 1, 2 are arranged so that the center points P1, P2 of the array antennas 1, 2 are slightly apart from each other. More specifically, a distance d' between the center points P1, P2 of the array antennas 1, 2 (hereinafter, referred to as "the center-to-center distance d'") is so determined that the angle of the first zero point of the array factor determined by the center-to-center distance d' equals the angle of the first side lobe point of the pattern of the individual array antennas 1, 2. The array antennas 1, 2 are electrically connected in phase so as to become excited in phase. "The antennas 1, 2 are electrically connected in phase" means that all the feed lines connecting a feed point S to the individual array elements 3 have the same length. This in-phase connection is not illustrated in FIG. 2 because it would complicate the drawings. FIG. 3 illustrates an example of the wiring system for achieving the in-phase connection. Besides the wiring system as shown in FIG. 3, other methods may be employed to achieve the in-phase connection, for example: a method in which phase shifters are provided in the feed lines; and a method in which the lengths of the feed lines of array elements relatively close to the feed point S are increase.

The antenna device thus constructed can be used as both a transmitting antenna and a receiving antenna without having to make any change in the construction.

Because a combined pattern of the antenna device is obtained by multiplying the pattern of the individual array antennas by the array factor according to the multiplication principle, the above antenna device, in which the angle of the first zero point of the array factor is equal to the angle of the first side lobe point, achieves a combined pattern in which the first side lobe is reduced.

Next explained will be determination of the center-to-center distance d' which achieves the optimal reduction of the side lobe level in the case where each of the array antennas 1, has a number N of array elements 3 arranged equidistantly at intervals d and has a uniform electric field distribution.

First, the pattern of each array antenna is obtained from the following expression (1):

$$[\sin(N\cdot 2\pi/\lambda\cdot d/2\cdot\sin\theta)/\{N\cdot\sin(2\pi/\lambda\cdot d/2\cdot\sin\theta)\}]\cdot g(\theta) \quad (1)$$

where $\lambda$ is the radio wave wavelength, $\theta$ is the angle from the antenna beam direction, $g(\theta)$ is the pattern of the array elements of the array antenna. Based on the expression (1), the angle $\theta$ of the first side lobe point approximately satisfies the following expression (2):

$$N\cdot 2\pi/\lambda\cdot d/2\cdot\sin\theta = 3\pi/2 \quad (2)$$

The array factor is obtained from the following expression (3):

$$\cos(2\pi/\lambda\cdot d'/2\cdot\sin\theta) \quad (3)$$

where d' is the center-to-center distance between the array antennas 1 and 2. The conditions by which the array factor provides the first zero point at the angle $\theta$ which satisfies the expression (2) are obtained from the following expression (4):

$$2\pi/\lambda\cdot d'/2\cdot\sin\theta = \pi/2 \quad (4)$$

Therefore, based on the expressions (2) and (4), the optimal center-to-center distance d' is written as the following expression (5):

$$d' = N/3\cdot d \quad (5)$$

The expression (5) requires a condition where $N \neq 3n$ (n being a positive integer) because if N is a multiple of 3, then d' becomes a multiple of d, resulting in overlap of array elements of the array antennas 1 and 2.

Although the optimal center-to-center distance d' has been thus obtained on the assumption that the array antennas have a uniform electric field distribution, optimal center-to-center distances for antennas having other patterns of electric field distribution can be obtained in generally the same manner.

Figure 4:
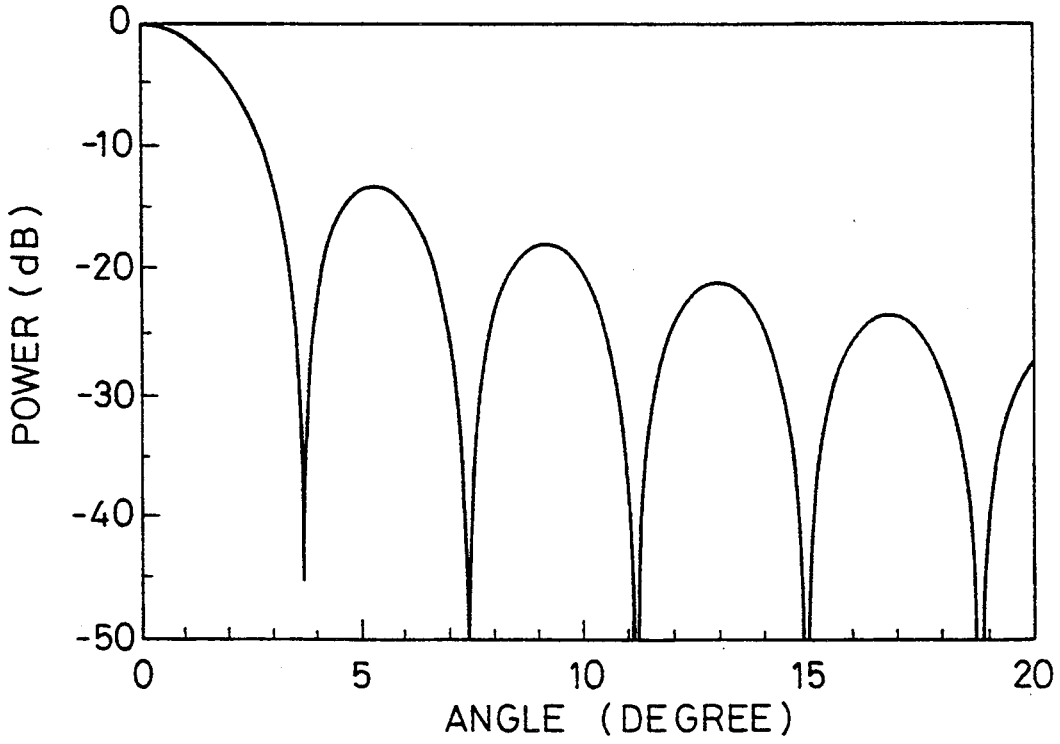
FIG. 4 indicates the power pattern of each array antenna of an antenna device according to the present invention.
Figure 5:
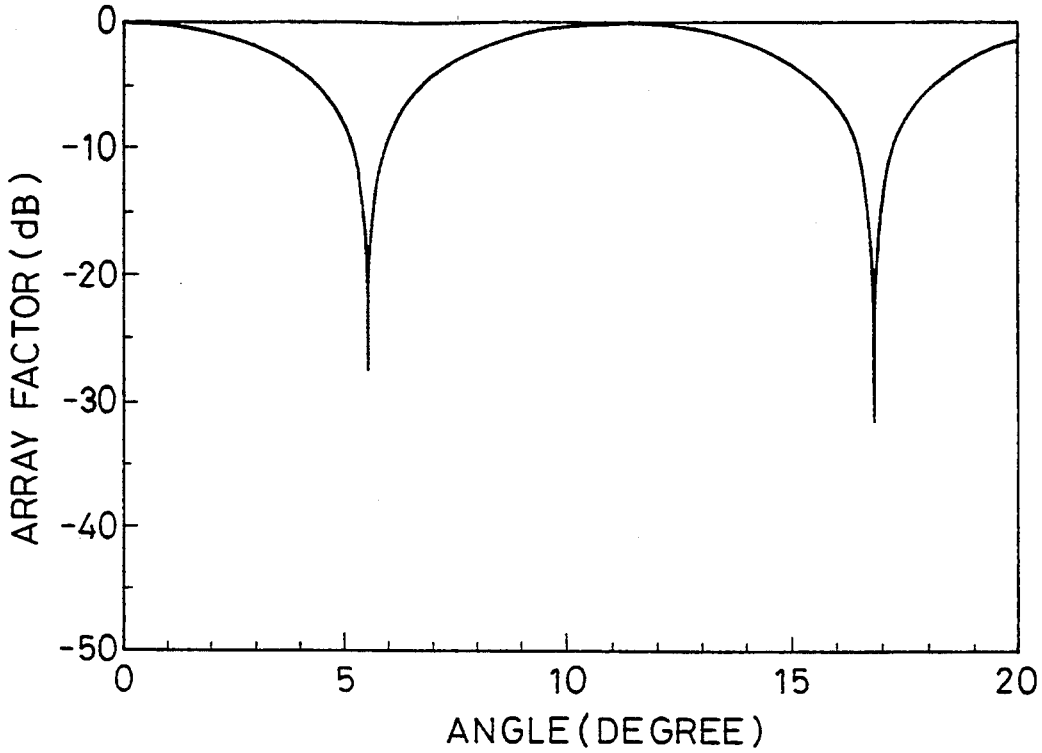
FIG. 5 indicates the pattern of the array factor based on the center distance between the array antennas of an antenna device according to the present invention.
Figure 6:
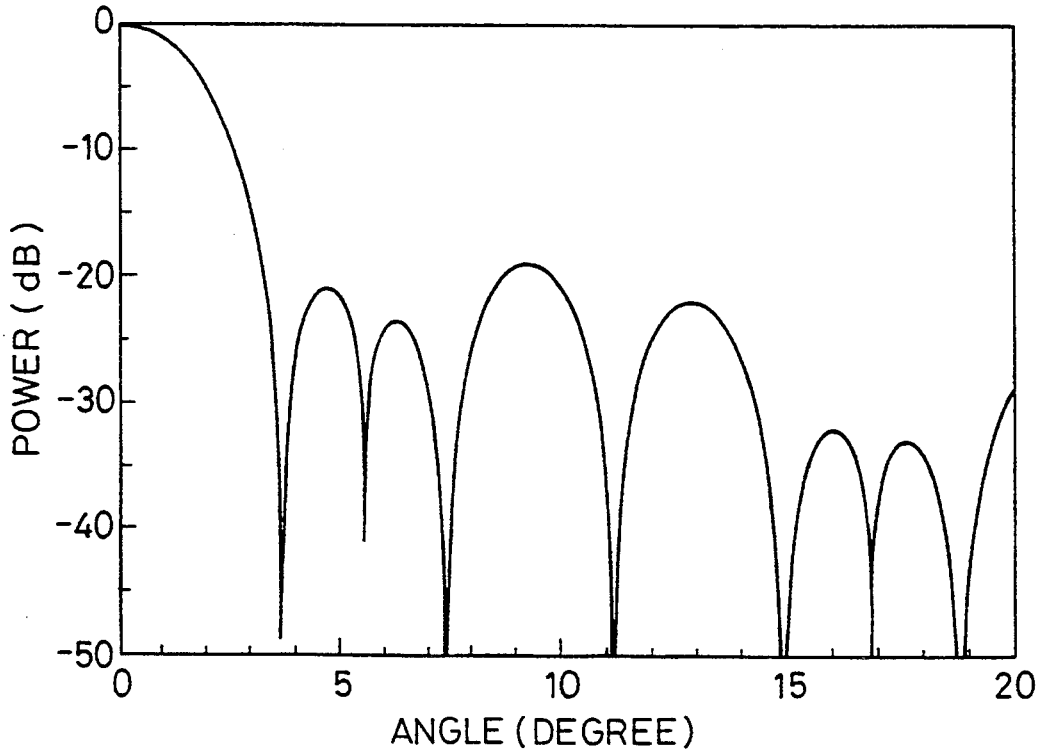
FIG. 6 indicates the combined power pattern of an antenna device according to the present invention.

FIGS. 4 to 6 show the results of the simulation of an antenna device as shown in FIG. 2 according to the present invention which reduces the side lobe level. The simulation was performed on the assumption that each of the array antennas of the antenna device had a uniform electric field distribution and comprised 31 array elements (N=31) arranged equidistantly at intervals of 0.5λ (d=0.5λ) and, further, that the array elements were half-wave dipole antennas with reflectors (the distance between the array elements and the reflectors being λ/4) which were arranged so that the dipole axes were parallel to the y axis perpendicular to the x axis. FIG. 4 shows the power pattern of the individual array antennas 1 and 2. FIG. 5 shows the pattern of the array factor determined based on the center-to-center distance d' (=31/3·d=5.17λ) between the array antennas 1 and 2. FIG. 6 shows the combined power pattern of the antenna device constructed as shown in FIG. 2. These figures indicate that the maximum side lobe level can be reduced from about −13 dB in the pattern of the individual array antennas to about −18 dB in the combined pattern of the antenna device according to the present invention. The figures further indicate that even the beam width can be slightly reduced.

Figure 1:
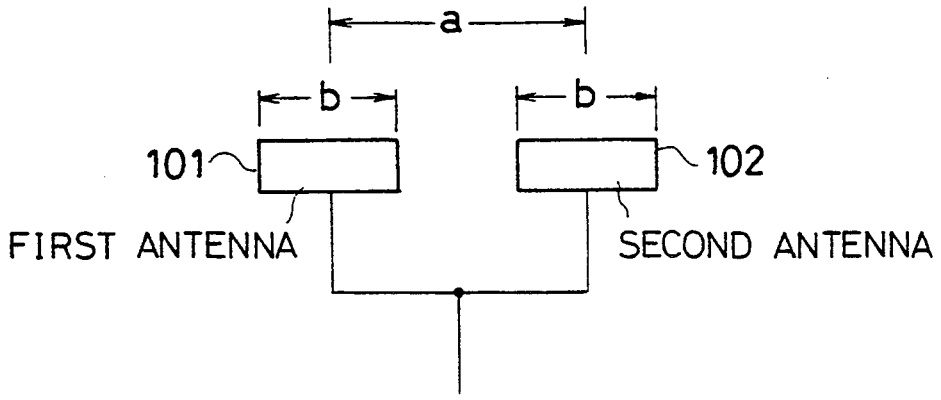
FIG. 1 PRIOR ART
FIG. 1 illustrates the construction of a known antenna.
Figure 7:
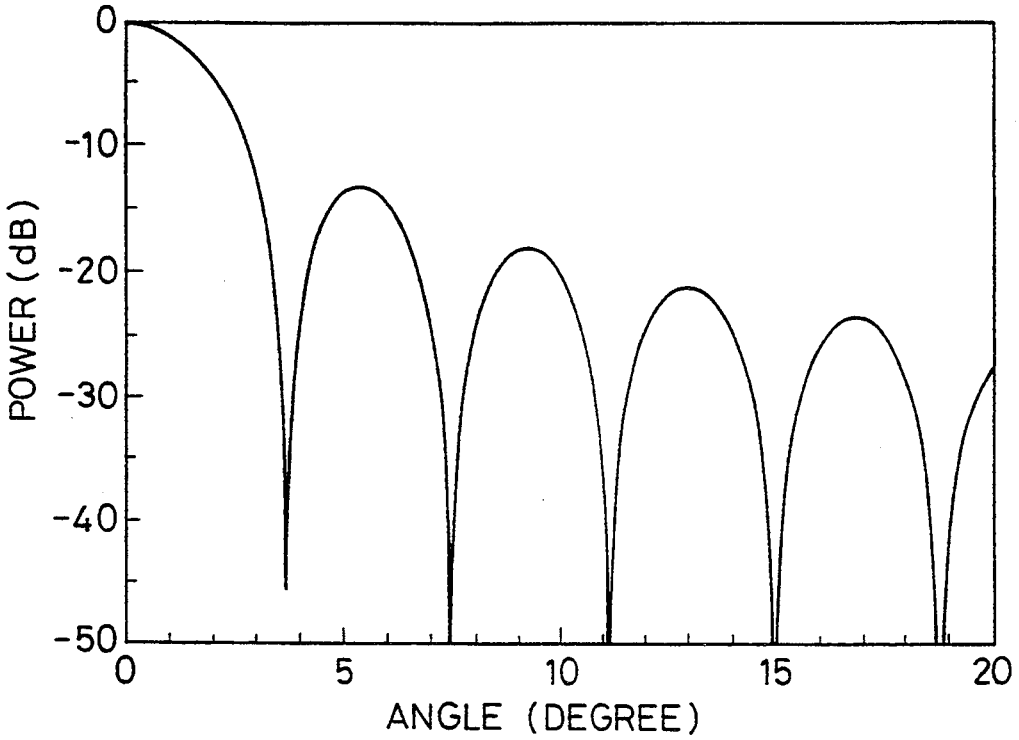
FIG. 7 PRIOR ART
FIG. 7 indicates the power pattern of the known antenna device shown in FIG. 1.
Figure 8:
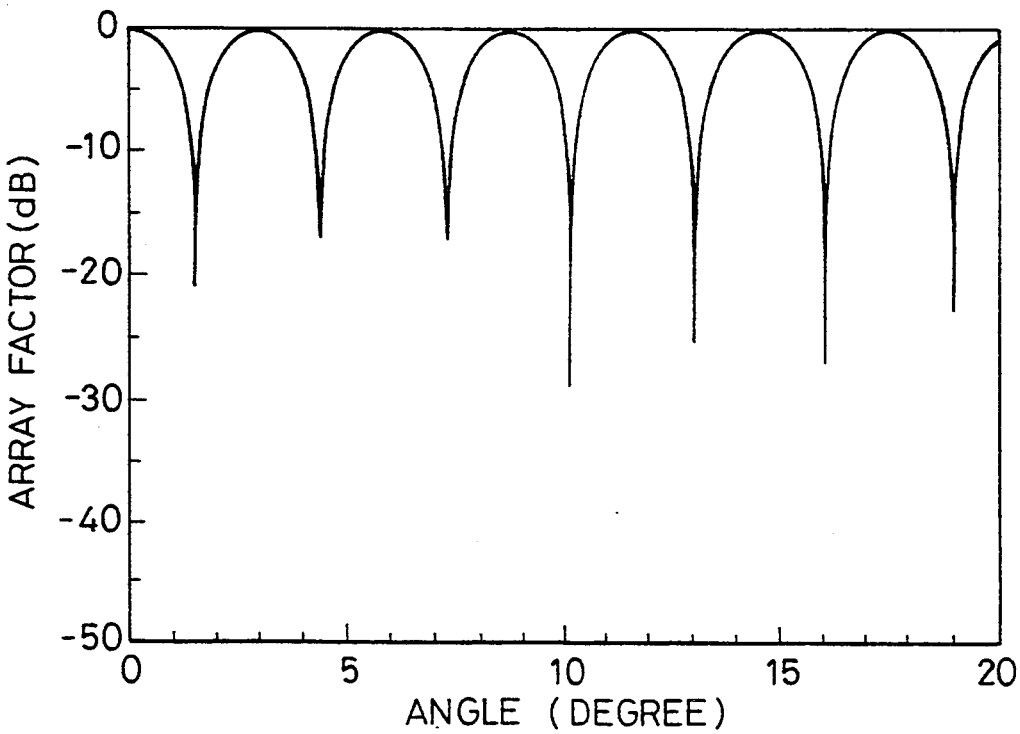
FIG. 8 PRIOR ART
FIG. 8 indicates the pattern of the array factor of the known antenna device shown in FIG. 1.
Figure 9:
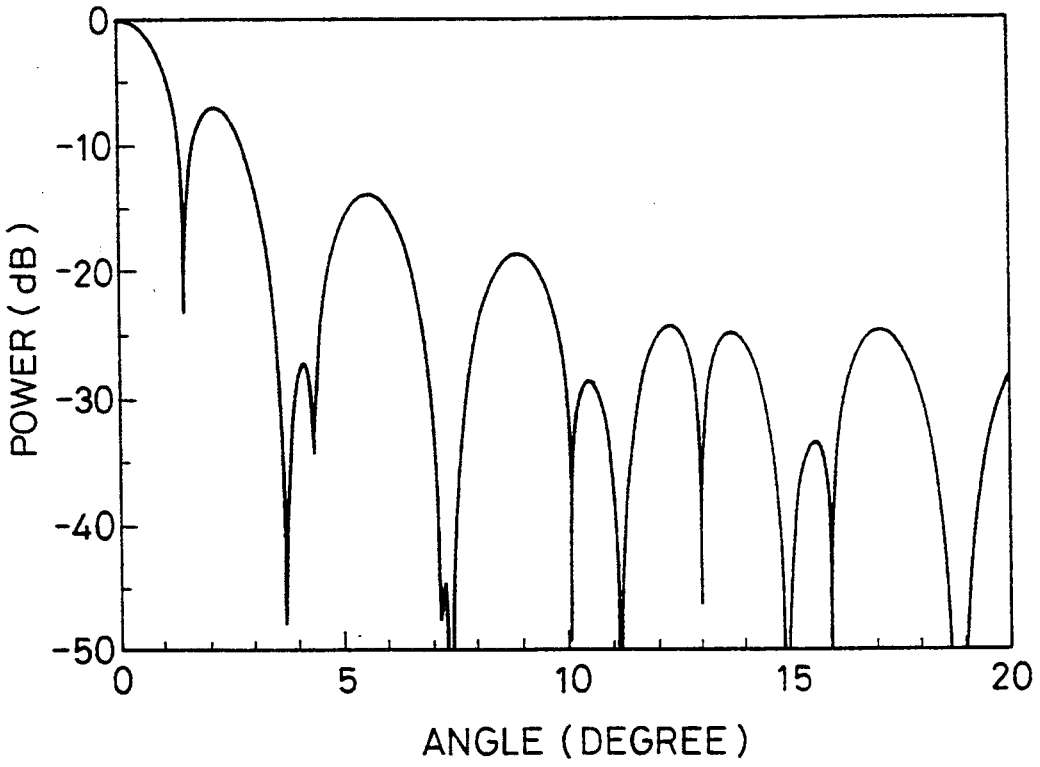
FIG. 9 PRIOR ART
FIG. 9 indicates the combined power pattern of the known antenna device shown in FIG. 1.

For comparison, FIGS. 7 to 9 shows the results of the simulation of the known antenna device, as shown in FIG. 1, in which the center-to-center distance is greater than the aperture length of each array antenna. The simulation was performed on the assumption that the two array antennas of the known antenna device were the same as those employed in the antenna device according to the present invention but shifted away from each other by a center-to-center distance d'=20λ. FIG. 7 shows the power pattern of the individual array antennas. FIG. 8 shows the pattern of the array factor determined based on the center-to-center distance between the two array antennas. FIG. 9 shows the combined power pattern of the conventional antenna device. These figures indicate that the conventional antenna device achieves almost no reduction of the maximum side-lobe level.

Figure 10:
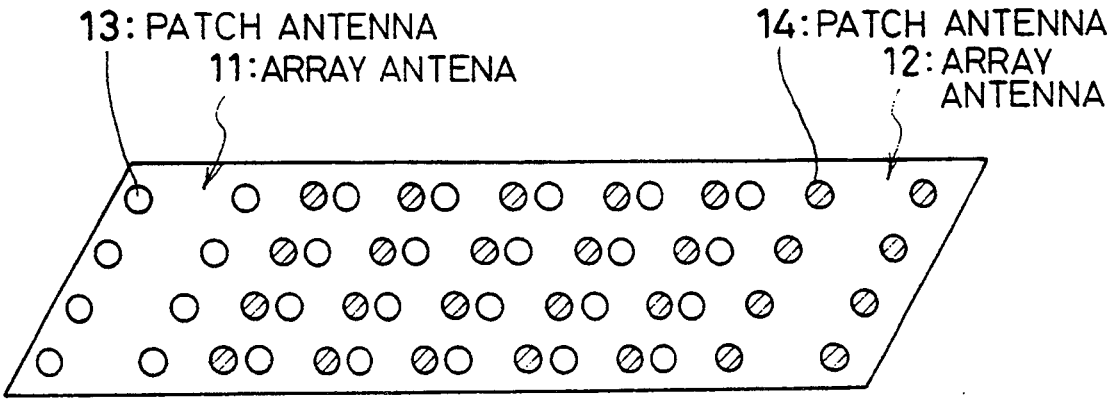
FIG. 10 illustrates the construction of an antenna device according to the present invention.
Figure 11:
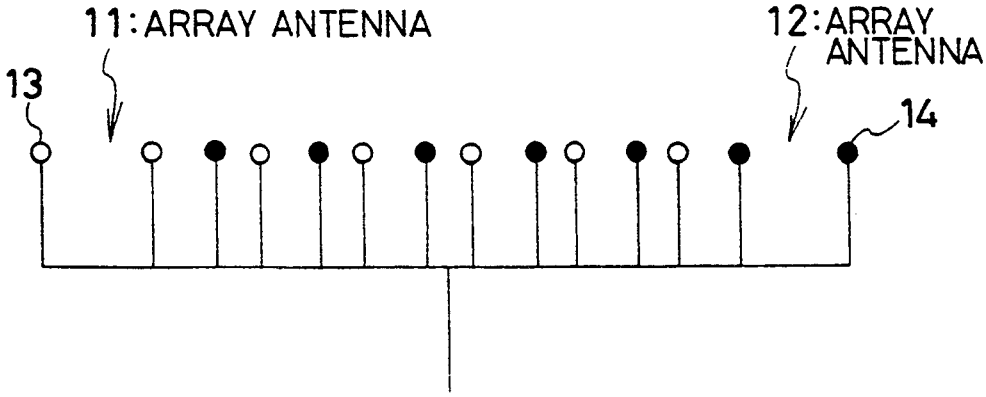
FIG. 11 illustrates an equivalent circuit of the antenna device shown in FIG. 10.

FIG. 10 illustrates the construction of an antenna device according to the present invention. Each of array antennas 11 and 12 comprises patch antennas 13 and 14, respectively, as the array elements. All the patch antennas 13, 14 of the array antennas 11, 12 are connected in phase. The equivalent circuit of this antenna device is shown in FIG. 11.

As described above, the antenna device of the present invention achieves a combined antenna pattern in which the first side lobe is eliminated at the angle of the first side lobe point of each array antenna, thus reducing the side lobe level without increasing the beam width.

While the present invention has been described with reference to what is presently considered to be the preferred embodiment, it is to be understood that the invention is not limited to the disclosed embodiments. To the contrary, the invention is intended to cover various modifications and equivalent arrangements included within the spirit and scope of the appended claims.

What is claimed is:

1. An antenna device having low side-lobe characteristics, comprising:

a first array antenna having a center and a radiation pattern which has a first side lobe point at a first angle;

a second array antenna which is substantially identical to said first array antenna, said second array antenna having a center and a radiation pattern which has a first side lobe point at a first angle;

said first array antenna and said second array antenna each being oriented in a same direction so as to form a combined antenna pattern having a side lobe during operation, and said center of said first array antenna being spaced apart from said center of said second array antenna by a specified center-to-center distance, such that said first array antenna and said second array antenna together have an array factor which has a first zero point at a predetermined angle; wherein said specified center-to-center distance having a magnitude which causes said angle of said first zero point of said array factor to equal said angle of said first side lobe point of said radiation pattern of each of said first and second array antennas; and means for electrically connecting said first and second array antennas in phase, whereby a side lobe level of said side lobe of said combined antenna pattern is reduced.

2. An antenna device having low side-lobe characteristics according to claim 1, wherein each of said array antennas comprises element equidistantly arranged so as to achieve a uniform electric field distribution, and, and the center-to-center distance is determined by a following formula $$d' = (N/3) \cdot d$$

where: d′ is the center-to-center distance; N is an umber of elements of each of said array antennas, excluding multiples of 3; and d i an interval between elements.

3. An antenna device having low side-lobe characteristics according to claim 1, wherein said means includes a feed point and feed lines connecting said feed point individually to elements of each of said array antennas, said feed lines having a same length.

4. An antenna device having low side-lobe characteristics according to claim 2, wherein said means includes a feed point and feed lines connecting said feed point individually to elements of each of said array antennas, said feed lines having a same length.

5. An antenna device having low side-lobe characteristics according to claim 1, wherein said means includes a feed point, feed lines connecting said feed point individually to elements of each of said array antennas, and a phase shifter provided at least one of said feed lines.

6. An antenna device having low side-lobe characteristics according to claim 2, wherein said means includes a feed point, feed lines connecting said feed point individually to elements of each of said array antennas, and a phase shifter provided at least one of said feed lines.

* * * * *